United States Patent [19]

Cannarozzo

[11] 4,094,082

[45] June 13, 1978

[54] PERPETUAL CALENDAR

[76] Inventor: Pedro Nicolas Cannarozzo, Tinogasta 3174, Buenos Aires, Argentina

[21] Appl. No.: 728,400

[22] Filed: Sep. 30, 1976

[30] Foreign Application Priority Data

Oct. 7, 1975 Argentina ..... 260713

[51] Int. Cl.[2] ..... G09D 3/00

[52] U.S. Cl. ..... 40/107; 40/120

[58] Field of Search ..... 40/107, 109, 120, 152.1; D19/20, 25; D6/235; 248/473

[56] References Cited

U.S. PATENT DOCUMENTS

| | | | |
|---|---|---|---|
| 247,000 | 9/1881 | Bath | 40/107 |
| 1,109,814 | 9/1914 | Bailey | 40/107 |
| 1,635,927 | 7/1927 | Curtis | 40/107 |
| 3,956,837 | 5/1976 | Itano | 40/152.1 |

*Primary Examiner*—John F. Pitrelli

*Attorney, Agent, or Firm*—Michael J. Striker

[57] ABSTRACT

A perpetual calendar is provided having a frame defining an enclosure with a frontal portion provided with first indicia representing days of a week, and, within the enclosure, seven prisms removably mounted in said frame, and provided with second indicia located beneath said first indicia representing days of a month.

3 Claims, 4 Drawing Figures

PERPETUAL CALENDAR

BACKGROUND OF THE INVENTION

The present invention refers to a perpetual calendar, for the use preferably on desks of offices, and which presents a particular constructive disposition, such as will be explained in the following description.

SUMMARY OF THE INVENTION

In accordance with the invention, said perpetual calendar comprises a vertical support, provided below with an extension, which forms its bearing surface. This support is formed by two lateral vertical prismatic members, erected parallelly and backed by a posterior plate, which forms, together with a transparent frontal sheet, a rectangular flattened parallelopiped, with its top side opened. The frontal transparent sheet has near its upper edge, a line of indicia denoting the week's days.

Within the parallelopiped, are introduced seven long prisms of a square section, showing on their lateral sides several numbers, forming a column and corresponding to some days of the month. These long prisms are located closely next to each other in the described lodging, and the length of each of the seven juxtaposed prisms corresponds to the length of the lodging, while the combined width of their equal sides, corresponds to the width of the lodging and, therefore, once located in their places, they rest duly immobilized inside of the mentioned lodging.

For being supported on the desk, the lower end of a lodging is provided with a curving leading to an extensive horizontally directed plate, which forms a support, together with the curviform extension of the posterior backing plate.

BRIEF DESCRIPTION OF THE DRAWING

In order to make the present invention clearly comprehensable and make it easy for applying in practice, it is represented in its preferable form of execution in the attached drawings, in which:

The FIG. 1 represents a perspective view of calendar.

Figure 2:
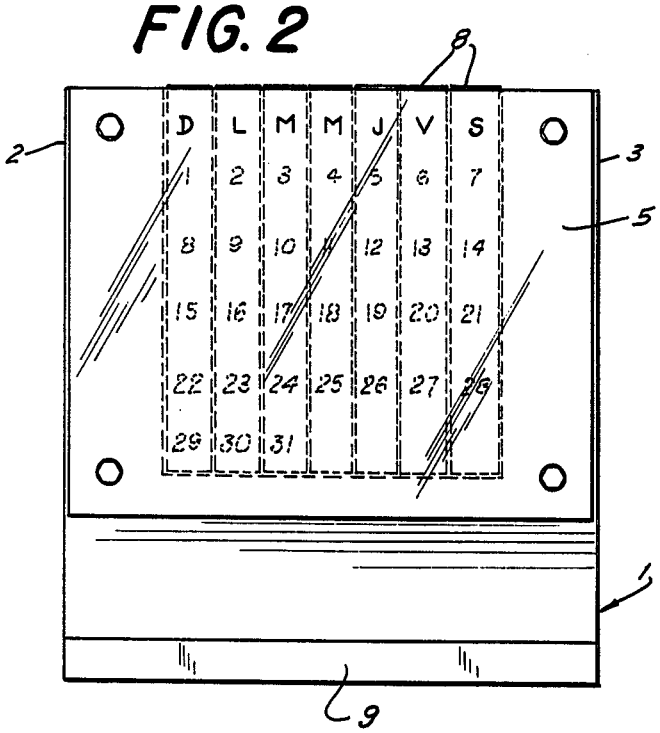

The FIG. 2 represents a frontal view of same.

Figure 1:
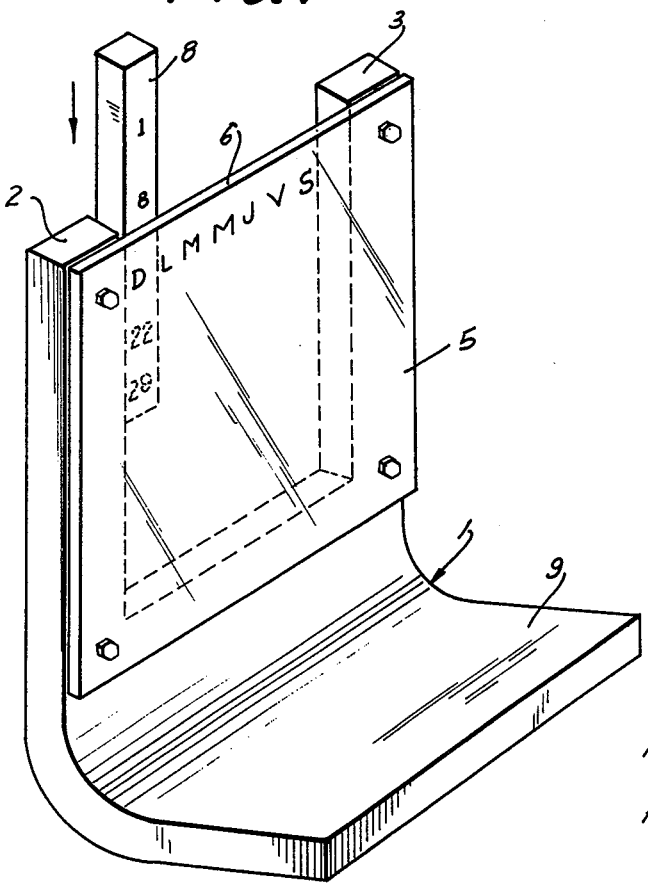
Figure 3:
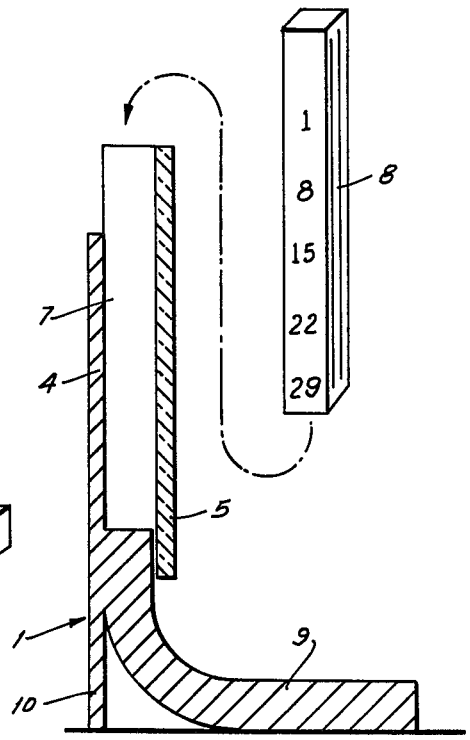

The FIG. 3 represents a view of a vertical section of the calendar's lodging, indicating separately where must be introduced one of the square long prisms, with the numbers of some days of the month, marked on its lateral side.

Figure 4:
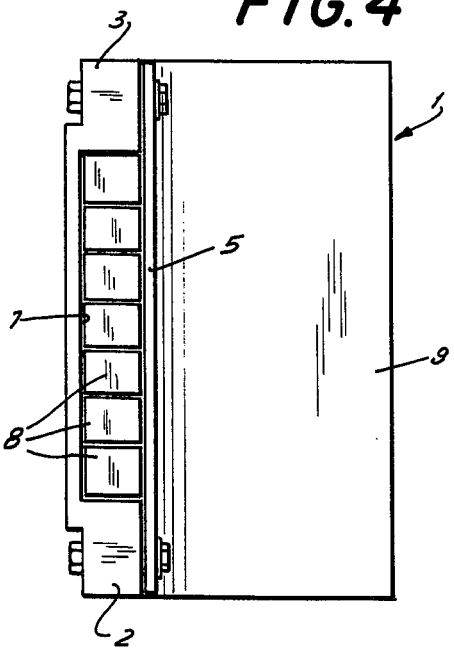

The FIG. 4 represents a view in plan of the calendar.

In said figures the same numbers of reference indicate the same parts.

SPECIFIC DESCRIPTION OF A PREFERRED EMBODIMENT

As regards the drawings - 1 indicates the calendar's support, provided on each of its sides by the straight upright members 2 and 3, parallel in part with them, backed and connected to a rectangular plate 4.

On the front side of the mentioned lateral members, a transparent sheet 5 is fixed with screws; on the top part of this sheet 5, near its upper edge, are engraved the names or the abbreviations of the seven weekdays.

Between the backing plate 4 and the frontal transparent sheet 5 is formed an enclosure 7 having a shape of rectangular flattened parallelopiped, which comprises the lodging for locating the corresponding series of long rectangular prisms 8, (seven in total), on which lateral sides are engraved the columns of numbers, indicating the days of the month.

As it can be observed in FIG. 4, said prisms 8 are located next to each other — in juxtaposed relation — filling all the space of the enclosure 7, because the length of same is practically equal to the length of each of the seven square sections of the prisms 8 and its width is equal to a combination of the widths of a single side from each of the prisms 8.

For securely footing the body 1 of the support, its lower zone is extended in a curve leading to a bearing plate 9, which, for better stability, extends to the end of an extension 10 of the rear backing plate 4. Said bearing plate 9, apart from being a good support, can also be used for supporting writing utensils.

The numbers engraved on the faces of the long prisms 8, are disposed differently on each prism, in such a way that the prisms can be duly located every month, in order that the engraved numbers indicate correctly the corresponding week's days, marked on the transparent sheet 5.

It is evident that the modifications of details can be introduced in the calendar, if they are forming part of the scope of the present invention, which is clearly determined by the clauses of the claims, which are following the present description.

Being described the present invention and the way it can be applied in practice, it is declared to claim as the exclusive propriety and right the following:

1. A perpetual calendar, comprising in combination, a frame defining an enclosure which is open at its top, and including two substantially upright, spaced and elongated prisms facing each other and each having a rear surface, a front surface and a bottom surface; a substantially upright rear sheet spanning said spaced prisms and being connected to the rear surfaces of said prisms; an at least partially transparent, substantially upright front sheet spanning said spaced prisms in such a manner that said front sheet is spaced a substantially constant distance from said rear sheet and being connected to the front surfaces of said prisms; a J-shaped unitary curviform first support having a substantially constant horizontal breadth and including a curved portion intermediate a substantially horizontally extending rectilinear portion and a substantially upright rectilinear portion having a free horizontally directed end face, the free end face being unitarily bonded to the bottom surfaces of said spaced prisms and extending from one prism to the other; and a substantially rectilinear, upright second support having an upper end face and a lower end face, said second support longitudinally extending below and in substantially the same plane as said rear sheet, and having a top end face and a bottom end face, the top end face being unitarily bonded with the substantially upright rectilinear portion of said first support and the bottom end face being located in a horizontal plane in which the horizontally extending rectilinear portion of said first support lies, the substantially horizontally extending rectilinear portion of said first support having an elongated substantially horizontally extending upper surface, whereby writing instruments and the like can be supported in a horizontal position on this upper surface, said front sheet being rectangular, and the curved portion of said curviform first support curves outwardly relative to said front sheet and away from the horizontally extending rectilinear portion; and further comprising seven elongated prismatic bodies removably mounted within the enclosure defined by said frame and provided with indicia representing the days of the month, each prismatic body is a column having a length equal to the vertical distance between the free end face of the substantially upright rectilinear portion of said first support and the top of said front sheet, said front sheet being provided with indicia representing the days of the week, the indicia being located in such a manner that each of them are above the indicia represented on each of said prismatic bodies, said seven prismatic bodies completely filling the enclosure defined by said frame, and each of said prismatic bodies having lateral sides equal to the lateral sides of said prisms, said rear sheet having an upright length which is less than the upright length of said front sheet, so as to facilitate removal of said prismatic bodies.

2. A calendar as defined in claim 1, the enclosure having the form of a parallelopiped, and wherein said prisms and said curviform first support together have a J-shape.

3. A calendar as defined in claim 1, said rear sheet being unitarily bonded to rear portions of the free horizontally directed end face of said first support.

* * * * *